United States Patent [19]

Adrian

[11] 4,185,346

[45] Jan. 29, 1980

[54] SAFETY DEVICE FOR SAIL YACHTS

[75] Inventor: Fritz Adrian, Ratingen, Fed. Rep. of Germany

[73] Assignee: Balcke-Dürr Aktiengesellschaft, Ratingen, Fed. Rep. of Germany

[21] Appl. No.: 847,484

[22] Filed: Nov. 1, 1977

[30] Foreign Application Priority Data

Nov. 10, 1976 [DE] Fed. Rep. of Germany ..... 2651181

[51] Int. Cl.[2] ..... B63B 17/00

[52] U.S. Cl. ..... 9/1.7; 114/39

[58] Field of Search ..... 114/39, 102, 108, 109; 9/1.1, 1.7, 14

[56] References Cited

U.S. PATENT DOCUMENTS

| | | | |
|---|---|---|---|
| 748,960 | 1/1904 | Lamb | 114/102 |
| 3,223,064 | 12/1965 | White | 114/39 |

*Primary Examiner*—Trygve M. Blix
*Assistant Examiner*—Sherman D. Basinger
*Attorney, Agent, or Firm*—Martin A. Farber

[57] ABSTRACT

A safety device for sailing yachts with substantially flat and/or construction-free deck and with articulation points for the shrouds, which articulation points are located spaced from the ship's side. At both sides of the mast, respectively, one safety railing each is arranged. The safety railing extends arched substantially in the longitudinal direction of the ship as well as spaced from the ship's side and is secured on the shrouds.

3 Claims, 2 Drawing Figures

SAFETY DEVICE FOR SAIL YACHTS

Figure 1:
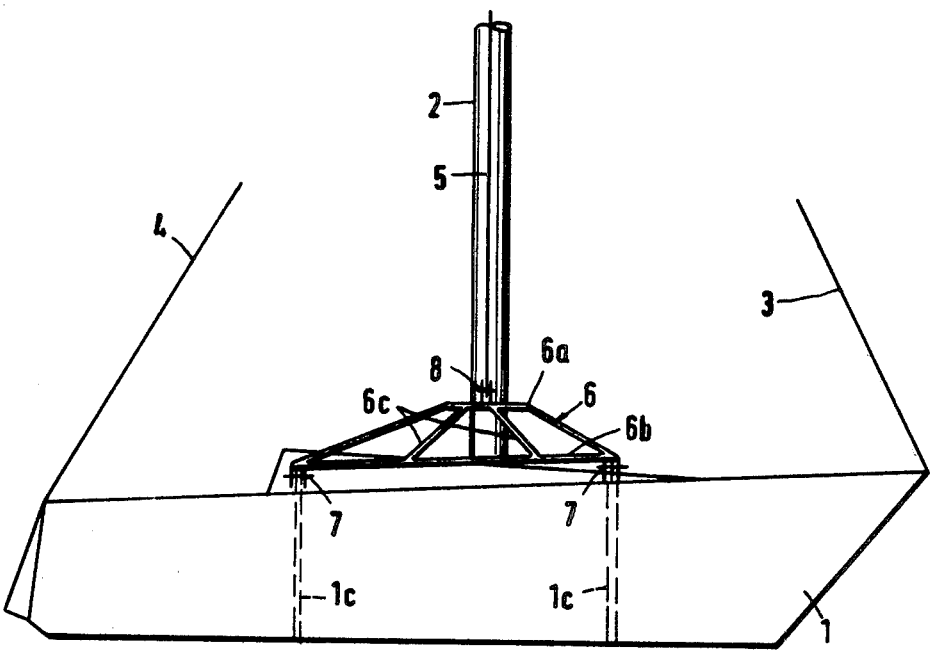

The invention relates to a safety device for sailing yachts with substantially flat and/or construction-free deck and with articulation points for the shrouds, which articulation points are located spaced from the ship's side.

Modern sailing yachts particularly of middle sizes differ from older ships, among other things, by a wider, more compact shape, by a drawn-up ship's side and by a substantially flat deck. With older ships laterally adjacent to the deck structures or constructions usually a corridor or passageway was arranged, which on the one side was limited and safeguarded by the sea railing and on the other side was safeguarded with a handrail secured on or at the deck constructions. With modern ships with extensive flat or construction-free upper deck, there exist as devices for holding tight only the sea railing and the stays and shrouds, which are required for bracing the mast.

Devices for holding tight are important, particularly in the vicinity of the mast, since here with the setting of the sail, recovering of the sail or with other work, one must stand secure, particularly when work is to be done with both hands. In addition to the possibility of carrying a safety belt, it is only possible with modern sailing yachts, either to support oneself on the shrouds, on the mast or on a device provided for this.

As devices for support, in addition to handrails on the mast, supports are known which are arranged in the vicinity of the mast on the deck. These supports must be proped cross-wise to the longitudinal axis of the ship in order to be able to receive the considerable forces occurring with violent ship movements. Such cross-struts have the disadvantage that they constrict the main traffic direction on the deck of a ship which direction runs in the longitudinal direction of the ship and endanger walking on the deck. Handrails arranged on the mast are indeed well suited to fasten thereon safety lines from safety belts; however they offer no possibility to support a service person thereon. Moreover such type of handrails on the mast many times hinder work on the sails and traps.

The invention is based on the object and task to provide a safety device for sailing yachts with substantially flat and/or construction-free deck, which without the disadvantage of the known devices offers a service or operating person in the vicinity of the mast a secure hold on the deck.

It is another object of the present invention to aid the solution of the above-mentioned object in the manner that at both sides of the mast, respectively, a safety railing is each arranged, which safety railing extends arcuately-shaped approximately in the longitudinal direction of the ship as well as spaced from the ship's side, and on which railing the shrouds are secured.

With the safety railing in accordance with the invention a device is provided which, without cross-struts which would disadvantageously influence the safe walking on the deck, receives the forces occurring during a supporting, and which makes possible a free passage from the cockpit to the foreship by displacement of the fastening place of the shrouds on the safety railing. The length of the safety railing which extends substantially in the longitudinal direction of the ship and its curved or arched course facilitates a safe support also of many service people in the entire range of the mast, so that the standing safety on the deck of modern sailing yachts is considerably improved.

According to a further feature of the invention the safety railing is fastened on the deck by means of articulation joints, so that the forces exerted by the shrouds and by service personnel on the safety railing are introduced moment-free into the deck of the yacht. Preferably also the shrouds are fastened by means each of an articulation joint on the safety railing in order to exclude the origination of moments.

With a preferred embodiment form of the invention the safety railing is made of an arcuate-shaped upper belt, a lower belt extending substantially parallel to the deck, and diagonal members running between both parts joined thereto. This safety railing which is reinforced, supported and stiffened in the manner of a framework, also by using light materials with small dimensions is in a position to receive all forces which occur deformation-free.

Finally with the invention it is proposed to connect the articulation joints for the fastening of the safety railing through the deck with one bulkhead each in order to lower the loadings of the deck. The length of the sea railing in this manner can be adjusted or adapted to the prevailing conditions in view of the presence of bulkheads.

Figure 2:
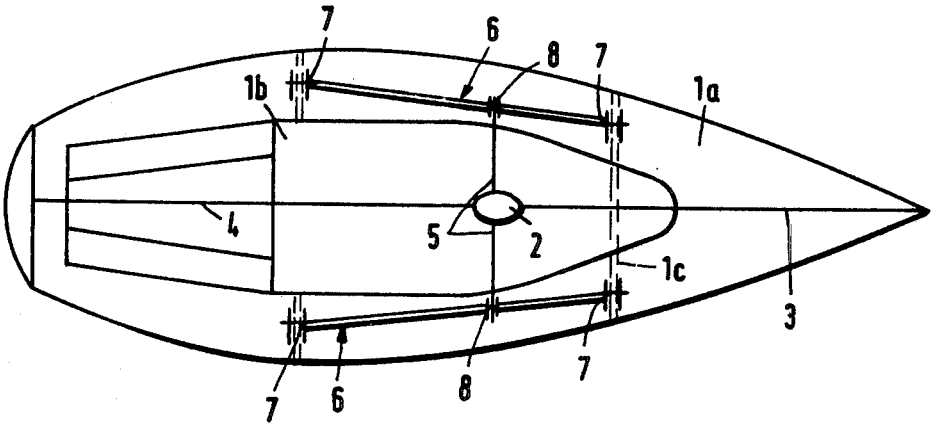

With the above and other objects and advantages in view, the present invention will become more clearly understood in connection with the following detailed description of a preferred embodiment, when considered with the accompanying drawings, of which:

FIG. 1 is a side view of a sailing yacht with the safety railing in accordance with the invention; and FIG. 2 is a top plan view of the sailing yacht of FIG. 1.

The merely schematically illustrated sailing yacht possesses a hull or body 1 with a substantially flat deck 1*a*, on which there is arranged only a low structure or construction 1*b*. The sloop-rigged sailing yacht has a mast 2 which is braced by means of a forestay 3, a permanent or standing backstay 4 and shrouds 5.

Substantially parallel to the longitudinal axis of the body or hull 1 at both sides of the mast 2, respectively, one safety railing 6 each is arranged on the deck 1*a*, which railing runs spaced from the sea railing (not illustrated in the drawing). Each safety railing 6 in the illustrated embodiment example comprises an arcuate-shaped upper belt 6*a*, a lower belt 6*b* which runs substantially parallel to the deck 1*a* and a plurality of diagonal members or struts 6*c* which extend between these two parts. The safety railing 6, which each extends substantially over one-third of the length of the hull 1 in the range of the mast 2, is secured on the front and rear ends, respectively, each by means of an articulation joint 7 on the deck 1*a*, so that with a loading of the safety railing 6 no moments can be introduced into the hull 1. With the illustrated embodiment example the articulation joints 7 are arranged in the range of bulkheads 1*c* of the hull 1 in order to avoid a point-like loading of the deck 1*a*.

In order to make possible a free passage from the cockpit to the forebody between the sea railing and the safety railing 6, the shrouds 5 likewise are secured by means of articulation joints 8 on the safety railing 6. By means of the framework type formation of the safety railing 6 with the upper belt, strap or chord 6*a*, the lower belt, strap or chord 6*b*, and the diagonal members 6*c*, the safety railing 6 is in the position also to carry off the forces, which are introduced by the shrouds 5, into the hull 1.

As illustrated in FIG. 1 the safety railings converge toward the front of the ship and the articulation pivots are mounted pivotal about respective axes which are parallel to the longitudinal axis of the yacht. As illustrated in FIG. 1 each safety railing is substantially of trapezoidal form and the articulation joints 7 are connected at the ends of the longer lower belt 6*b*.

As may be recognized from FIGS. 1 and 2, with the safety railing 6, in the range of the mast 2 a safety apparatus is provided on which people standing on the deck can safely support themselves and hold tight. The safety railing 6 produces neither a wind attack surface of any consequence, nor does it have transverse struts which would make walking on the deck more difficult.

While I have disclosed one embodiment of the invention it is to be understood that this embodiment is given by example only and not in a limiting sense.

I claim:

1. A safety device for sailing yachts with a mast and with a substantially flat and construction-free deck, respectively, and with articulation points for shrouds, which articulation points are positioned spaced from the ship's side, comprising one safety railing each being arranged at both sides of the mast, each said safety railing extends arched substantially in the longitudinal direction of the ship as well as being spaced from the ship's side, and the shrouds, respectively being fastened to each said safety railing, said safety railing includes, a curved upper belt, a lower belt extending substantially parallel to the deck, and struts extending between said lower belt and said upper belt.

2. The safety device as set forth in claim 1, wherein said safety railing has a substantially trapezoidal outer shape.

3. The safety device as set forth in claim 1, wherein said lower belt is disposed substantially under said upper belt, and said struts constitute diagonal members.

* * * * *